US008827026B2

(12) United States Patent
Foster et al.

(10) Patent No.: US 8,827,026 B2
(45) Date of Patent: Sep. 9, 2014

(54) BARRIER FOR USE WITH SEATBELT BUCKLE AND SYSTEM INCLUDING SAME

(71) Applicant: Oceaneering International, Inc., Hanover, MD (US)

(72) Inventors: Samuel T. Foster, Perry Hall, MD (US); Eric Arthur King, Westminster, MD (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 14/055,835

(22) Filed: Oct. 16, 2013

(65) Prior Publication Data

US 2014/0101900 A1 Apr. 17, 2014

Related U.S. Application Data

(60) Provisional application No. 61/714,607, filed on Oct. 16, 2012.

(51) Int. Cl.
*B60K 28/10* (2006.01)

(52) U.S. Cl.
USPC ..... 180/274; 24/633; 24/641; 24/642

(58) Field of Classification Search
USPC ..... 180/274; 24/164, 165, 184, 793.1, 633, 24/641, 642
See application file for complete search history.

(56) References Cited

U.S. PATENT DOCUMENTS

| | | | | |
|---|---|---|---|---|
| 4,432,119 | A | 2/1984 | Schwark et al. | |
| 4,624,033 | A * | 11/1986 | Orton | 24/633 |
| 4,742,886 | A * | 5/1988 | Sato | 180/268 |
| 7,538,283 | B2 * | 5/2009 | Muromachi | 200/61.58 B |
| 7,882,604 | B2 * | 2/2011 | Suzuki | 24/633 |
| 7,988,196 | B2 * | 8/2011 | Wang | 280/801.1 |
| 8,621,729 | B2 * | 1/2014 | Nimura | 24/642 |
| 2005/0241123 | A1 | 11/2005 | Willard et al. | |
| 2007/0232126 | A1 * | 10/2007 | Suzuki | 439/489 |
| 2008/0246327 | A1 | 10/2008 | Collins et al. | |
| 2012/0144630 | A1 * | 6/2012 | Nimura | 24/593.1 |
| 2012/0256403 | A1 * | 10/2012 | Shields | 280/733 |
| 2012/0319386 | A1 * | 12/2012 | Bahr et al. | 280/733 |
| 2012/0324685 | A1 * | 12/2012 | Kataoka et al. | 24/637 |

FOREIGN PATENT DOCUMENTS

ES 1075667 U 11/2011

* cited by examiner

*Primary Examiner* — Toan To
(74) *Attorney, Agent, or Firm* — McKenna Long & Aldridge LLP

(57) ABSTRACT

A barrier may be configured to maintain a fixed position with respect to a seat, the barrier separating a first space from a second space, a seatbelt buckle may be configured to maintain a fixed position with respect to the barrier in the second space, the buckle includes an opening to receive a seatbelt tongue and a release button to release the tongue from the buckle, the barrier may include a slot having dimensions selected to permit passage of the tongue from the first space into the opening and prevent an object from passing through the slot to operate the release button. A force-transfer-structure, coupled between the release button and a solenoid may transfer a force exerted by the solenoid to the release button, where the buckle and force-transfer-structure maintain operational alignment therebetween. A second structure can operate the release button in event that the solenoid is inoperable.

20 Claims, 10 Drawing Sheets

BARRIER FOR USE WITH SEATBELT BUCKLE AND SYSTEM INCLUDING SAME

This application claims priority to U.S. Provisional Application No. 61/714,607, filed Oct. 16, 2012, the entire contents of which are included by reference herein.

FIELD OF THE INVENTION

The present invention is directed to an apparatus for use with seatbelt buckles that have a tongue release button on the body of the buckle. These seatbelt buckles are exemplified by conventional seatbelt buckles used in automobiles. More specifically, the present invention is directed to a barrier placed before the seatbelt buckle, which allows passage of a seatbelt tongue into the buckle but prevents an object, for example a passenger's finger, a pen, a credit card, or a key, from operating the tongue release button of the buckle. The invention finds utility in passenger carrying structures, such as vehicles, in amusement park attractions; however, the invention is not limited to passenger carrying structures in the field of amusement park attractions.

BACKGROUND OF THE INVENTION

Amusement parks often include rides in which vehicles are used to transport passengers. Due to the nature of an amusement park ride, passengers must be restrained during the ride to inhibit them from exiting their seats.

There are many methods of restraining passengers in vehicles. These methods include lap bars and padded assemblies that capture a passenger's legs, torso, and/or shoulders. Each of these methods has any number of drawbacks that make it unsuitable for use in general, and that make it especially unsuitable for use in battery-operated lightweight vehicles. For example, lap bars are undesirable in general for vehicles in which a single bar serves to secure multiple passengers on a single row. Because passengers come in all shapes and sizes, the largest passenger in the row determines how close the lap bar can come to the remaining passengers in the row. Lap bars for individual seats are available; however, every individual lap bar may require its own opening and/or closing mechanism, which includes hinges and other mechanical parts. Multiplying the number of lap bars thus results in an increase in the weight and parts count of the vehicle.

Individual molded or padded restraints that pull down over a passenger's shoulders pose many of the same problems for vehicle designers as multiple lap bars. In addition to being weighty, these known means of securing passengers are expensive and occupy more space in a vehicle, in comparison, for example, to a conventional seatbelt system such as those found in automobiles.

Weight is an important design parameter for any vehicle. Designers of passenger vehicles, for use in an outside of amusement parks, may attempt to reduce the weight of their designs for any number of reasons including cost and fuel or power efficiency. In self-propelled battery operated vehicles, the weight and size of the vehicle may be critical design parameters. If a designer is able to reduce the weight of a battery operated vehicle, the designer could, for example, use smaller or fewer battery cells (and thereby reduce the weight of the vehicle even further), or for the same size battery as the original vehicle, the designer could extend the distance, or duration, of powered travel, or increase the number of passengers carried by the vehicle.

Use of a seatbelt system would appear to be an answer to several of the problems presented to the inventors. Well-known seatbelt systems, such as those used in automobiles, include a buckle component and a tongue component. The tongue is inserted into the buckle and is passively secured therein. Both the buckle and the tongue are tethered to individual lengths of flexible seatbelt webbing at first ends of the webbing. The webbing is typically anchored to a structure at the opposite second ends of the webbing. However, typical seatbelt systems are not appropriate for amusement park type ride vehicles, at least because passengers would be able to operate the release buttons found on seatbelt buckles and release themselves from the seatbelts. A passenger that is able to release himself from a seatbelt could leave the confines of the relatively safe ride vehicle, and wander into areas where risk of personal injury and even death might await.

Devices are known that prevent a small child from releasing the tongue of a seatbelt from its buckle, but these devices are child-safety devices—these devices allow an adult to release the tongue from the buckle. Devices are also known for use in prisoner transportation applications. These devices deprive a prisoner of the ability to release the tongue of a seatbelt from its buckle, while selectively giving that same ability to a law enforcement officer. Known devices of this type are temporarily installed over seatbelt buckles that are tethered to seatbelt webbing. The law enforcement officer is able to selectively release the tongue of the seatbelt from its corresponding buckle because he was entrusted to carry a key to permit the officer to depress the release button while the device is in place, or to permit the officer to remove the device from the buckle. Other systems that restrict passengers from releasing a seatbelt tongue from its buckle may exist, but known systems are understood to be expensive and complicated. At least because of complexity, weight, circumvention of the intended purpose of a device, lack of a permanent tamperproof installation, and/or cost, all known systems are less than desirable for use in battery-operated vehicles that convey passengers through an amusement park ride. One example of such a vehicle is known as a trackless dark ride vehicle (TDRV). As the name implies, a TDRV does not run upon, and is not guided by, a track.

As mentioned above, there is a tradeoff between the weight of a vehicle and the distance and length of time the vehicle can operate on battery power. The greater the weight, or the greater the operating time and distance of travel, the higher the dissipation of power stored in the battery. Additional drains on battery power may include sound, light, and vibration effects that may be utilized in a TDRV. Still another drain on the battery, if the TDRV is so equipped, includes the energy required to lift, drop, and tilt the seats of the TDRV's passengers.

What is needed is a lightweight, uncomplicated, and inexpensive (compared to known systems) seatbelt system that permits plurality of individual passengers to engage their own seatbelt tongues into seatbelt buckles and allows for an authorized simultaneous release of numerous seatbelt tongues from their respective buckles. The desired seatbelt system would simultaneously prevent passengers from operating the release button of his/her own seatbelt, thereby preventing each passenger from releasing his/her own seatbelt tongue from its buckle.

BRIEF SUMMARY OF THE INVENTION

The present invention obviates the aforementioned inconveniencies and deficiencies of conventional seatbelt systems and schemes associated with vehicles, and particularly associated with battery-operated vehicles for rides in amusement parks. In accordance with an embodiment of the invention, unmodified, lightweight, off-the-shelf seatbelt components may be used in conjunction with a barrier, where the barrier is configured to permit insertion of a seatbelt tongue into its buckle, but prevents a passenger from operating or otherwise tampering with the tongue release button of the buckle.

In one embodiment, an apparatus to prevent tampering may include a barrier configured to maintain a fixed position with respect to a seat, the barrier separating a first space, on a first side of the barrier, from a second space, on a second side of the barrier; a seatbelt buckle configured to maintain a fixed position with respect to the seat, and a slot penetrating the barrier and where the slot is dimensioned to permit passage of the seatbelt tongue from the first space into an opening of the seatbelt buckle and prevent an object from passing through the slot to operate the release button.

In another embodiment, the apparatus may include a seatbelt buckle secured to a seat, the seatbelt buckle including an opening that receives a seatbelt tongue and a release button to release the seatbelt tongue from the seatbelt buckle. A force-transfer-structure, having a first end configured to contact the release button, and a second end, distal to the first end, coupled to a plunger/shaft of a solenoid. The solenoid being configured to exert a force on the force-transfer-structure to operate the release button, where the seatbelt buckle and force-transfer-structure are positioned relative to one another to maintain operational alignment between the release button and the first end of the force-transfer-structure.

Furthermore, the apparatus may also include a housing covering at least a portion of the seatbelt buckle, a slot penetrating a surface of the housing and configured to permit the seatbelt tongue to pass through the slot and enter a releasably secured state with the seatbelt buckle, where a minimum size of the slot permits entry of the seatbelt tongue, and a maximum size of the slot prevents an object from passing through the slot and operating the release button.

Furthermore, the apparatus may additionally include a rotatable shaft, a lever extending transversely from the rotatable shaft, and a transverse member, extending from the force-transfer-structure and coupled to the lever, where a rotation of the rotatable shaft exerts a force on the force-transfer-structure to operate the release button as an alternative to the force exerted by the solenoid.

Still further, in some embodiments, a plurality of the apparatus described above may be joined in series, by joining the rotatable shafts of adjacent pairs of apparatus.

In still another embodiment, an apparatus to permit remote actuation of a seatbelt buckle release button and prevent a passenger from locally actuating the release button may include the seatbelt buckle, an electromechanical device configured to actuate the release button of the seatbelt buckle, a housing covering at least the seatbelt buckle, the housing having a slot penetrating a surface of the housing and configured to permit a seatbelt tongue to pass through the slot, where a minimum size of the slot permits entry of the seatbelt tongue into the seatbelt buckle, and a maximum size of the slot prevents an object from passing through the slot and operating the release button. The apparatus may further include a mechanical device configured to actuate the release button of the seatbelt buckle independently of the electromechanical device, where the electromechanical device and the mechanical device are not operable by the passenger.

It will be appreciated by persons skilled in the art that the advantageous benefits that can be achieved with the embodiments described herein are not limited to those embodiments. The advantages and benefits of and the configurations of all embodiments described herein will be more clearly understood from the following detailed description taken in combination with the accompanying drawings.

BRIEF DESCRIPTION OF THE DRAWINGS

Several figures are provided herein to further the explanation of the present invention. More specifically.

DETAILED DESCRIPTION

It is to be understood that both the foregoing general description and the following detailed description are exemplary. As such, the descriptions herein are not intended to limit the scope of the present invention. Instead, the scope of the present invention is governed by the scope of the appended claims.

The present invention obviates the problems described above by use of commercial off-the-shelf seatbelt restraint systems augmented with a barrier that allows a passenger to insert a tongue of a seatbelt into the seatbelt's buckle, but prevents the passenger from operating the seatbelt release button.

Figure 1C:
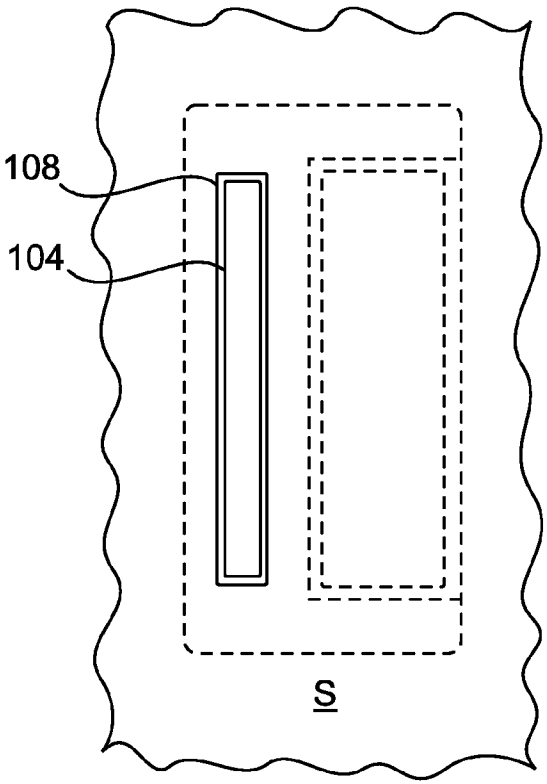
FIG. 1C is a front view of the portion of the barrier of FIG. 1B in operational alignment with, and positioned above, the seatbelt buckle of FIG. 1A, all in accordance with an embodiment of the invention.
Figure 1B:
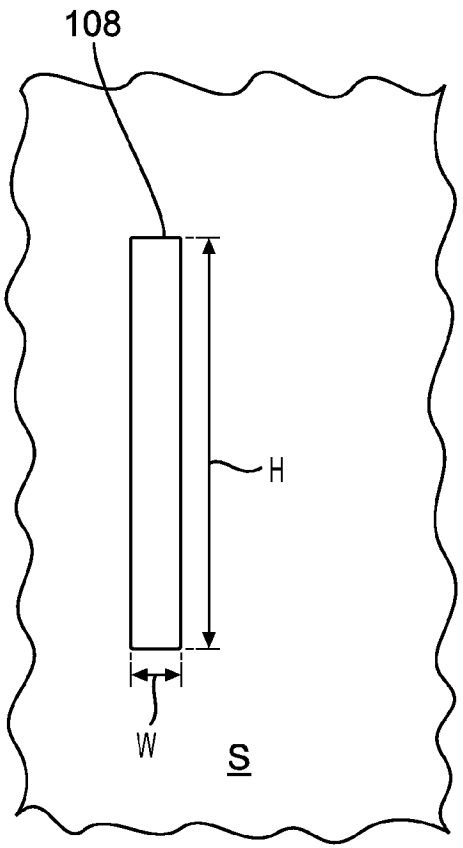
FIG. 1B is a front view of a portion of a barrier in accordance with an embodiment of the invention.
Figure 1A:
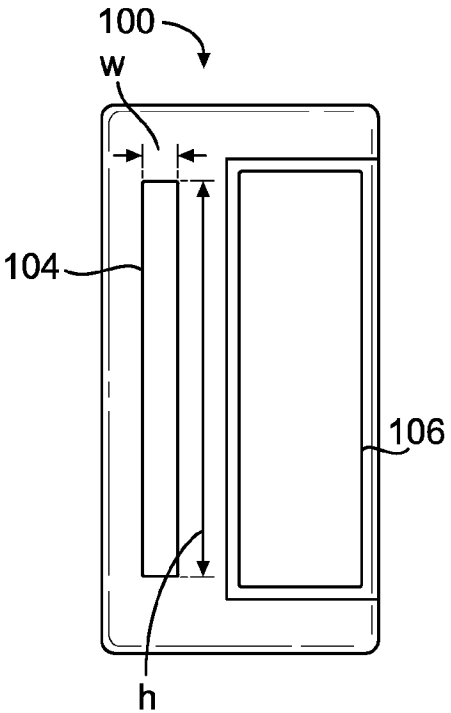
FIG. 1A PRIOR ART
FIG. 1A is a front view of a prior art seatbelt buckle.

FIG. 1A is a front view of a prior art seatbelt buckle 100. FIG. 1B is a front view of a portion of a barrier 102 in accordance with an embodiment of the invention. FIG. 1C is a front view of the portion of the barrier 102 of FIG. 1B in operational alignment with, and positioned above, the seatbelt buckle 100 of FIG. 1A, all in accordance with an embodiment of the invention. In FIG. 1C, the hidden portions of the seatbelt buckle 100 are shown in dashed lines.

The seatbelt buckle 100 may comprise a tongue opening 104 having a first predetermined height (h) and width (w), the tongue opening 104 is dimensioned such that the seatbelt buckle 100 may receive its corresponding seatbelt tongue 200 (FIG. 2). The seatbelt buckle 100 may further comprise a release button 106. Once the seatbelt tongue 200 is inserted to a predetermined depth into the seatbelt buckle 100 through the tongue opening 104, the tongue is releasably secured within the seatbelt buckle 100. Operating the release button 106, for example by pressing it with sufficient force, releases the seatbelt tongue 200 from the seatbelt buckle 100.

In the embodiment of FIG. 1B and 1C, the barrier 102 comprises a first surface (S). the barrier 102 has a depth or thickness, which is not shown on in FIG. 1B and 1C. The barrier 102 further comprises a slot 108 having a second predetermined height (H) and width (W). The walls of the slot 108 define an opening or void in the first surface S. The slot 108 penetrates through the first surface S to permit passage of the seatbelt tongue 200 therethrough. In accordance with an embodiment of the invention, the walls of the slot 108 are configured such that the minimum dimensions of the slot 108 may be given by $W \geq w$ and $H \geq h$. The maximum dimensions of the slot 108 are limited to make the slot 108 too narrow, for example, for a passenger's finger, a pen, or a key, to penetrate the barrier 102 and operate the release button 106. Practically speaking, to account for inexact alignment, of the slot 108 with the tongue opening 104 of the buckle 100, the dimensions of the slot 108 may need to be 0.1-0.5 inches larger, and more preferably 0.1-0.3 inches larger, than the dimensions of the tongue opening 104 to permit passage of the seatbelt tongue 200. Tolerances in the height and width dimensions need not be equal. Even at the maximum dimensions, the slot 108 would remain too narrow for a passenger to insert an object into the slot to a sufficient depth, and with a sufficient force, to successfully operate the seatbelt release button 106.

Moreover, as depicted in the embodiments of FIGS. 1A and 1C, the tongue opening 104 and release button 106 of the seatbelt buckle 100 are offset from each other. As depicted in FIG. 1C, even if the passenger was able to insert an object, for example, the passenger's finger, a pen, a credit card, a key, or some other object, into the slot 108, the object would need to rotate 90 degrees to traverse the region between the slot 108 and the release button 106 and then rotate another 90 degrees and extend in length in order to depress the release button 106 to a sufficient depth and with sufficient force to release the tongue 200 from the seatbelt buckle 100.

Even if, in an alternate embodiment (not shown), the release button 106 and the tongue opening 104 shared a common void in the body of the seatbelt buckle, that is, the release button 106 and the tongue opening 104 were not separated by an interstitial surface of the buckle, it must be noted that an unwanted insertion of an object into the slot 108 would only occur when the tongue 200 was fully inserted into the tongue opening 104, and secured in, the seatbelt buckle 100. Accordingly, the area of the slot 108 available for penetration is reduced by the cross-sectional area of the tongue 200, thereby increasing the difficulty of inserting any object having a rigidity necessary to depress the release button 106 with a sufficient force to a sufficient depth to release the tongue from the seatbelt buckle.

Figure 2A:
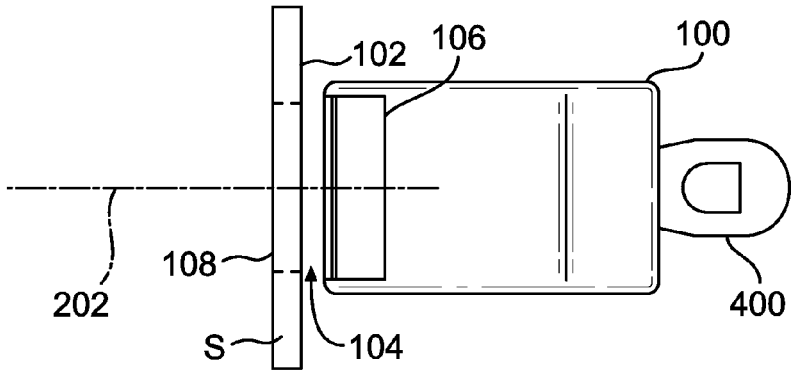
FIG. 2A is a side view of the portion of the barrier of FIG. 1B in operational alignment with, and spaced apart from, the seatbelt buckle of FIG. 1A, all in accordance with an embodiment of the invention.

FIG. 2A is a side view of the portion of the barrier 102 of FIG. 1B in operational alignment with, and spaced apart from, the seatbelt buckle 100 of FIG. 1A, all in accordance with an embodiment of the invention. The slot 108, penetrating through the barrier 102, is illustrated. An anchoring structure 400 (FIG. 4) is also illustrated.

As shown in FIG. 2A, the seatbelt buckle 100 is spaced-apart from the barrier 102. The amount of space separating the buckle 100 from the barrier 102 may depend on the length of the seatbelt tongue 200 and on the thickness of a mechanism (not shown) used to depress the seatbelt release button 106. One example of such a mechanism is described in greater detail below, with respect to FIGS. 7 and 8.

In operation, the barrier 102 separates a first space from a second space. The passenger occupies some portion of the first space. The seatbelt buckle 100 occupies some portion of the second space. The barrier 102 is intended to keep the passenger, or any object controlled by the passenger, out of the second space. The slot 108 in the barrier 102 penetrates through the barrier 102. The slot 108 may be aligned with the tongue opening 104 of the buckle 100 as shown in FIGS. 1C and 2A. In general, the center of the slot 108 and the center of the tongue opening 104 may be aligned on an imaginary axis 202 perpendicular to, and shared by, both the slot 108 and the tongue opening 104. The dimensions of the slot 108 are preferably selected to permit passage of the seatbelt tongue 200 from the first space into the tongue opening 104 of the seatbelt buckle 100 in the second space, and to prevent a passenger from inserting an object into the slot 108 to operate the release button 106.

In some embodiments, the barrier 102 might be a portion of a seating surface, or a portion of a surface between seats. The slot 108 of the barrier 102 could be formed in any suitable surface. The buckle 100 could be secured behind the slot 108.

Figure 2B:
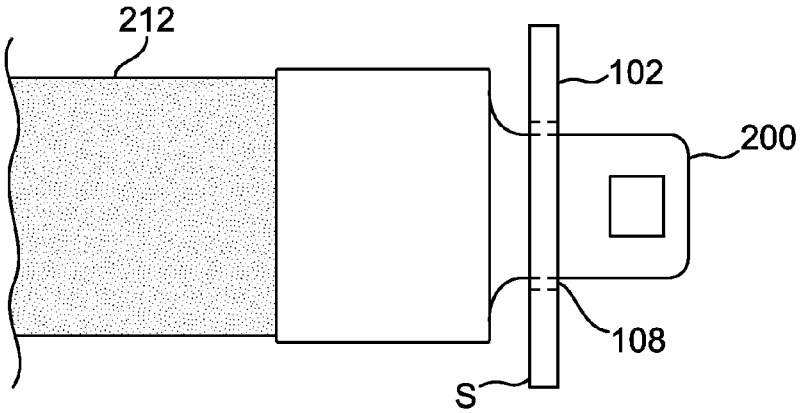
FIG. 2B is a side view of the portion of the barrier of FIG. 1B illustrating the positioning of a seatbelt tongue in a slot in the barrier of FIG. 1B.

FIG. 2B is a side view of the portion of the barrier 102 of FIG. 1B illustrating the positioning of a seatbelt tongue 200 in the slot 108 in the barrier 102 of FIG. 1B. The tongue 200 is illustrated as having been passed through the slot 108 from the first space to the second space.

Figure 2C:
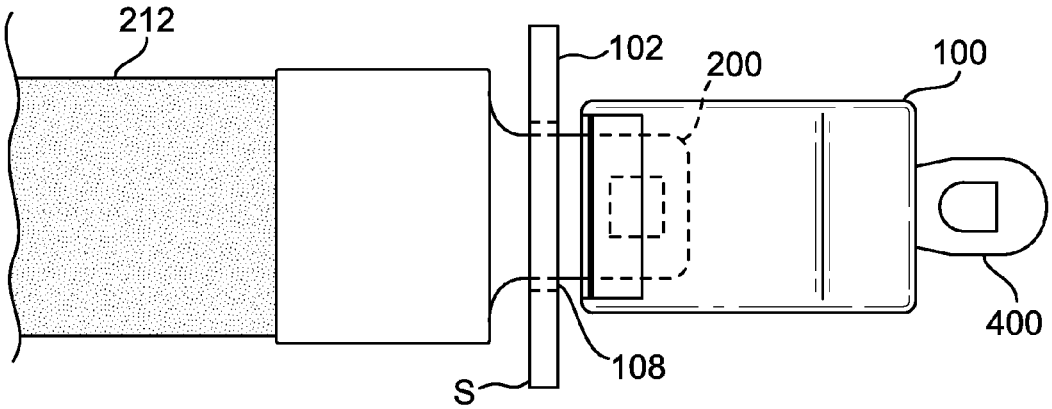
FIG. 2C is a side view of the portion of the barrier of FIG. 1B illustrating the seatbelt tongue inserted through the slot in the barrier and securedly received within the seatbelt buckle, all in accordance with the embodiment of the invention.

FIG. 2C is a side view of the portion of the barrier of FIG. 1B illustrating the seatbelt tongue 200 inserted through the slot 108 in the barrier 102 and removably secured within the seatbelt buckle 100, all in accordance with the embodiment of the invention.

Figure 3:
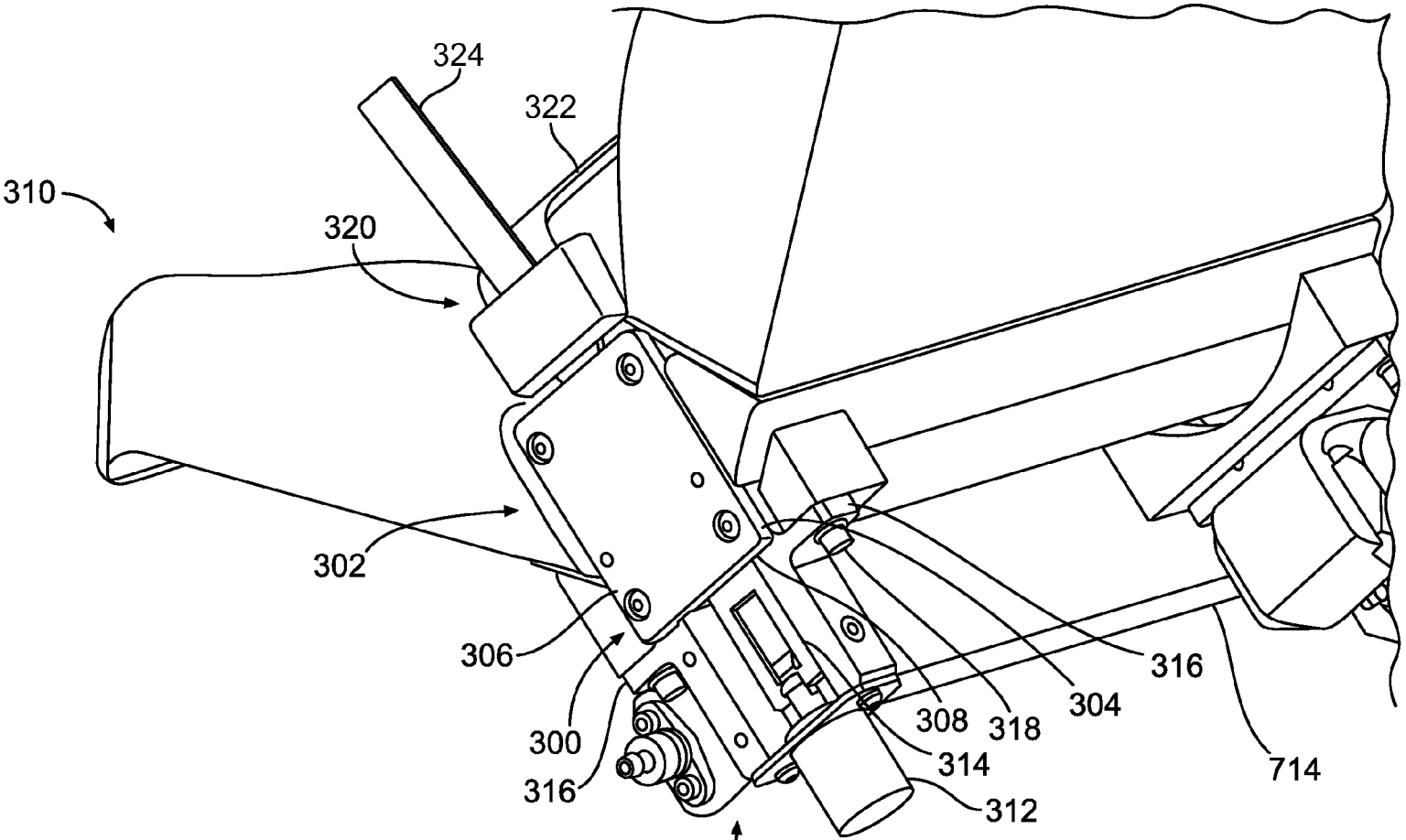
FIG. 3 illustrates a housing in accordance with an embodiment of the invention.

FIG. 3 illustrates a housing 300 mounted to a seat 310 in accordance with an embodiment of the invention. In some embodiments, such as that illustrated in FIG. 3, the barrier 102 might be a first wall (hidden from view) of the housing 300. In such an embodiment, the edges of the first wall might be considered as the edges of the barrier 102. The barrier 102, however, need not be flat. A slot 108 (FIG. 1) penetrates through the barrier 102 and/or first wall in the embodiment of FIG. 3. The four surfaces of the slot might be embodied as a slot in the barrier 102 and/or first wall, as a three sided channel in the edge of the first wall and a bottom edge of a cover bridging over the channel, or alternatively, the slot 108 might be embodied as a three sided channel in the edge of a cover bridging over the edge of the first wall. Second 304 and third (hidden from view) parallel opposing walls could extend from the barrier 102 and/or first wall. A fourth wall might be placed in contact with the first, second 304, and third walls to act as a cover 306 of the covered portion 302 of the housing 300. The cover 306 might be removably secured to the first second and/or third walls or the combination of first through fourth walls might be one piece that may be secured to the housing 300 or seat. In the embodiment of FIG. 3, the cover 306 is fixedly secured to the remainder of the housing 300 using, for example, screws. Regardless of the configuration, the housing 300 could be positioned over a seatbelt buckle (not shown, similar to 100) to prevent a passenger from operating the release button (not shown, similar to 106) of the seatbelt buckle 100.

In still another embodiment, the housing 300 might further include an additional fifth wall 308 opposite to the barrier and/or first wall. In still another embodiment, the housing 300 might be a six-sided container, having the seatbelt buckle (similar to 100) enclosed therein.

In the embodiment of FIG. 3, the housing 300 is comprised of a covered portion 302 and an uncovered portion 303. In this embodiment, the buckle 100 is positioned within the housing 300, under the cover 306. Visible in FIG. 3 is a solenoid 312 and a portion of a force-transfer-structure 314. Operation of the solenoid 312 and force-transfer-structure 314 will be described below. Flanges 316 extend from the housing 300. Bolts 318 may be used to secure the housing 300 to the seat 310.

A tongue 200 assembly 320 is illustrated as being inserted into the housing 300 (and therefore into the buckle 100, which is hidden beneath a cover 306. Seatbelt webbing 322 tethered to the tongue 200 and a locating tab 324 (used to allow passengers to quickly identify the tongue 200 and to pull the tongue free from the buckle 100 are included in the tongue 200 assembly 320.

In the embodiment of FIG. 3, the floor and walls of the housing 300 are integrated into a bracket that includes the flanges 316. The embodiment of FIG. 3 is only one of many possible configurations of housings. Various methods and structures may be used to secure the housing 300 to a seat 310 without affecting the scope of the invention. For example, the housing 300 may be a separate structure that is secured to a bracket using screws. The bracket may be bonded or otherwise secured to a portion of the seat of the vehicle. For example, in embodiments utilizing a fiberglass seat, the bracket may be bonded or bolted to a portion of the fiberglass seat.

Figure 4:
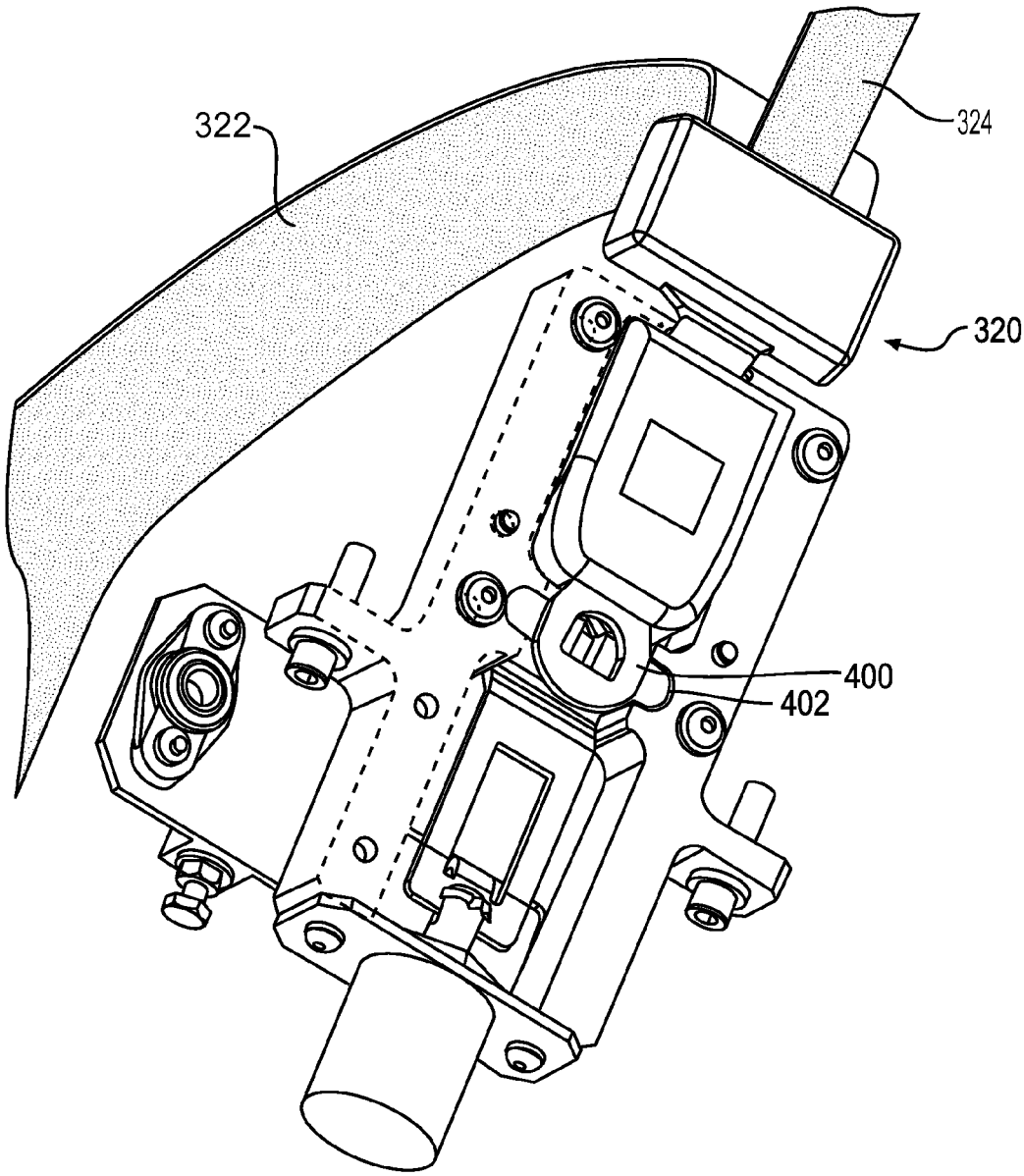
FIG. 4 is a perspective view of the housing of FIG. 3 with a cover removed, in accordance with an embodiment of the invention.
Figure 5:
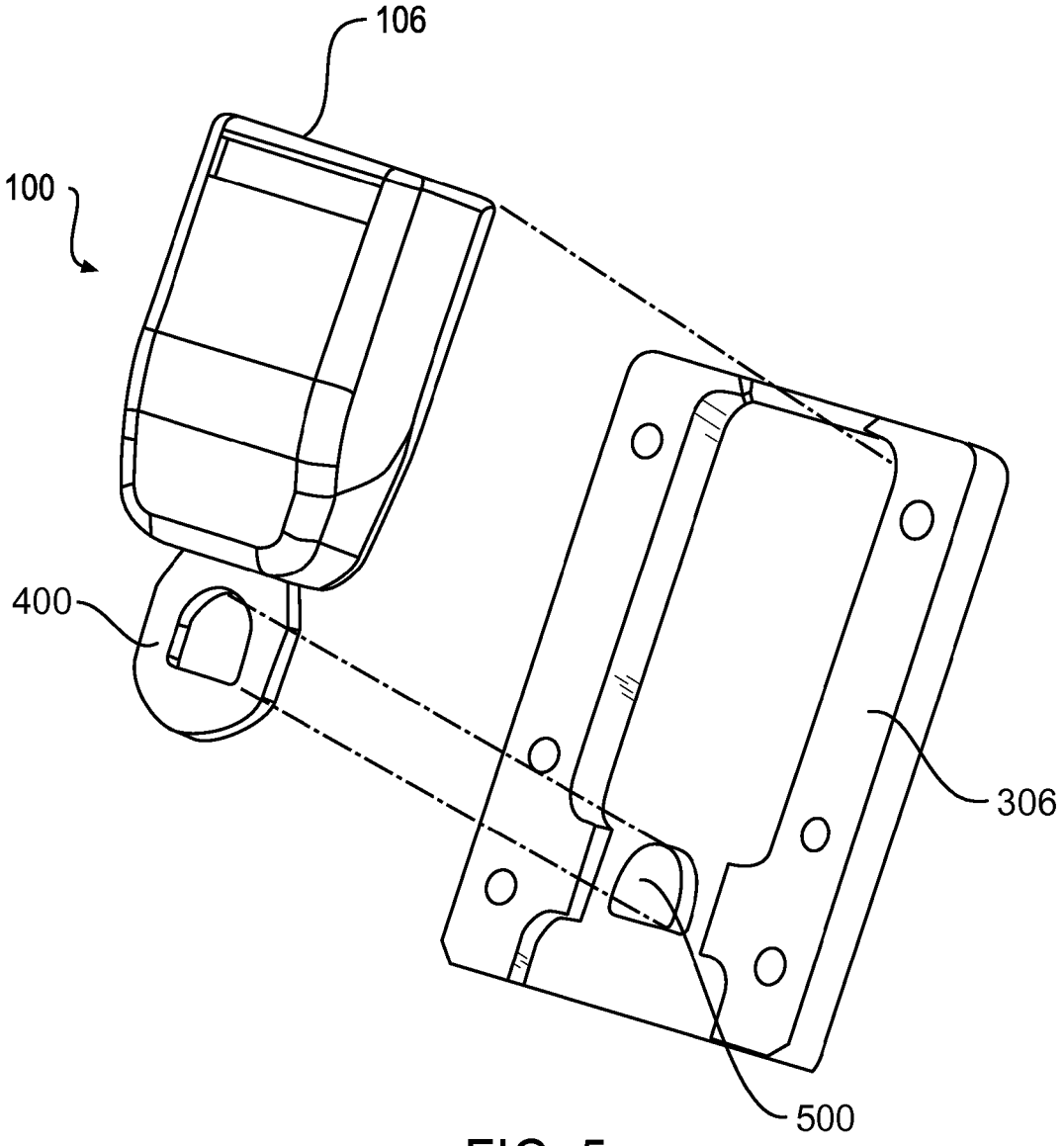
FIG. 5 is an exploded view of the cover of FIG. 3, illustrating the alignment of a seatbelt buckle with internal features of the cover, in accordance with an embodiment of the invention.

FIG. 4 is a perspective view of the housing 300 of FIG. 3 with the cover 306 removed from the covered portion 302 of the housing 300. FIG. 5 is an illustration of the underside features of the cover 306 in accordance with an embodiment of the invention. In a preferred embodiment, the anchoring structure 400 of the buckle 100 receives a boss 500 protruding from the underside of the cover 306. The housing 300, with the buckle 100 enclosed therein, is fixed, either directly or coupled via a bracket, to the seat 310. In this preferred embodiment, because the buckle 100 is fixedly coupled to the seat via at least the housing 300, there is no need for the buckle 100 to be tethered to seatbelt webbing (such as webbing 322). Elimination of seatbelt webbing and the fixtures required to connect the webbing to the vehicle reduces weight, parts count, and cost. Fixing the buckle 100 to the seat via the housing 300, rather than having the buckle tethered to any webbing, also provides a benefit of simplifying ingress of passengers to the vehicle, at least in that it eliminates delays caused by passengers not promptly securing themselves into the vehicle because they sat on the buckle or the buckle had disappeared between seat cushions or the like.

As described above, in one embodiment the anchoring structure 400 may be coupled to the housing 300 via boss 500 and the housing may then be fixed to the seat. In an alternate embodiment to those described above, a bolt (not shown) or other connector may be passed through the central opening of the anchoring structure 400 to facilitate anchoring the buckle 100 to a fixed portion of a seat or a fixed portion of vehicle adjacent to the seat.

In summary, the embodiment of FIGS. 3-5 includes: a housing 300, a cover 306, a solenoid 312, a force-transfer-structure 314, and a buckle 100. The buckle 100 is positioned within the confines of the housing 300. The solenoid 312 is secured to the housing 300 as illustrated. A portion of the force-transfer-structure 314, extends from the solenoid 312 and couples to the release button 106 of the buckle 100. As described with respect to FIG. 5, the cover 306 includes a boss 500 projecting therefrom. The boss 500 is received in an opening of the anchoring structure 400. The anchoring structure 400 extends from the buckle 100. In the embodiments of FIGS. 3-5, the height of the boss 500 and the thickness of the anchoring structure 400 are substantially similar. A spacer 402 may span across the surfaces of the boss 500 and at least a portion of the anchoring structure 400. The spacer may be sandwiched between these surfaces and a wall of the housing 300, or other surface, opposite to the boss 500. The spacer 402 may ensure that the anchoring structure 400 does not slip from its permanent position around the boss 500.

Figure 6A:
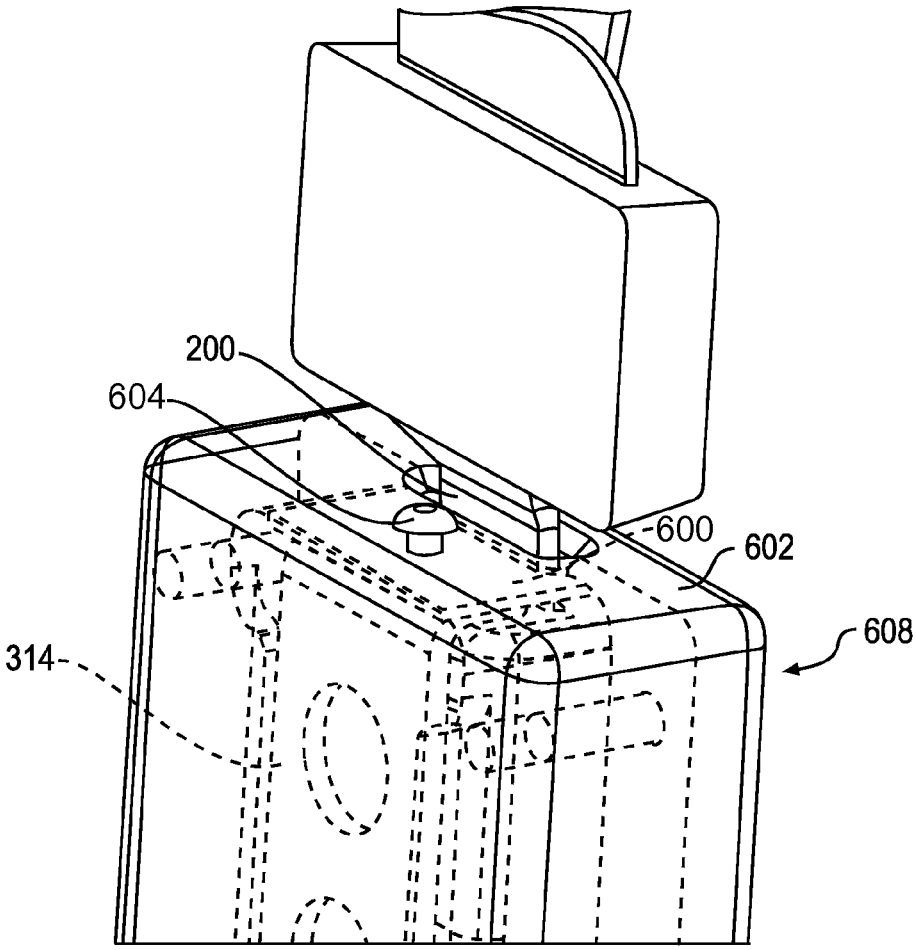
FIGS. 6A and 6B illustrate components of an alternate embodiment including a slot penetrating through a reinforced slotted plate, in accordance with an alternate embodiment of the invention.
Figure 6B:
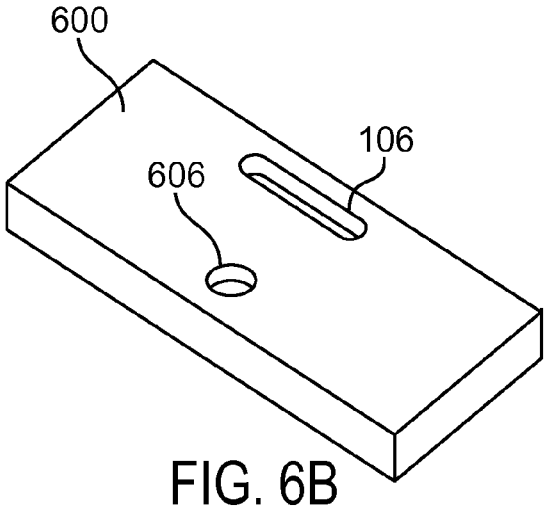

In the embodiments of FIGS. 3-5, once the cover 306 is installed, the seatbelt buckle 100 is hidden from view and passengers are blocked from interacting with the buckle 100, and specifically with the release button 106 of the buckle 100. FIGS. 6A and 6B illustrate components of an alternate embodiment including a slot 108 penetrating through a reinforced slotted plate 600, in accordance with an alternate embodiment of the invention.

In the embodiment of FIGS. 6A and 6B, the slot 108 may be comprised, a portion of the housing 300 and by a slotted plate 600. Preferably, the slotted plate 600 may be made of a material that is equal to or harder than, or in some respect more resilient than, the material used to fabricate the housing 300. The slotted plate 600 shields the release button 106 and any portion of the force-transfer-structure 314 that is positioned above the release button 106. The slotted plate, in cooperation with the barrier 102 and/or first wall 602 blocks the passenger from interacting with the release button 106. As described above, the slot 108 in the slotted plate 600 is only large enough to permit the tongue 200 to pass through. Once engaged with the buckle 100, the gap between the sides of the slot 108 and the surfaces of the tongue 200 are too small to permit passage of any object having a rigidity sufficient to transfer a force required to depress the release button 106, or any portion of the force-transfer-structure 314 positioned above the release button 106.

The slotted plate 600 may be secured to the inside of the housing 300 using a screw 604. In the embodiments of FIGS. 6A and 6B, the slotted plate 600 includes a threaded hole 606. The screw 604 passes through a mounting hole in the front wall of the housing 608 (similar to housing 300) and is received and secured in the threaded hole 606 of the slotted plate 600 using a thread-locking compound (not shown). The mounting hole may be substantially centered with and adjacent to the release button 106 of the buckle 100. However, the mounting hole 606 is filled with the screw 604. The screw 604 is not intended to be removed. The screw 604 does not permit free passage of any object through the mounting hole, where the object might be used to operate (depress) the release button 106 of the buckle 100, thereby releasing a removably secured tongue 200 from the buckle.

Figure 7:
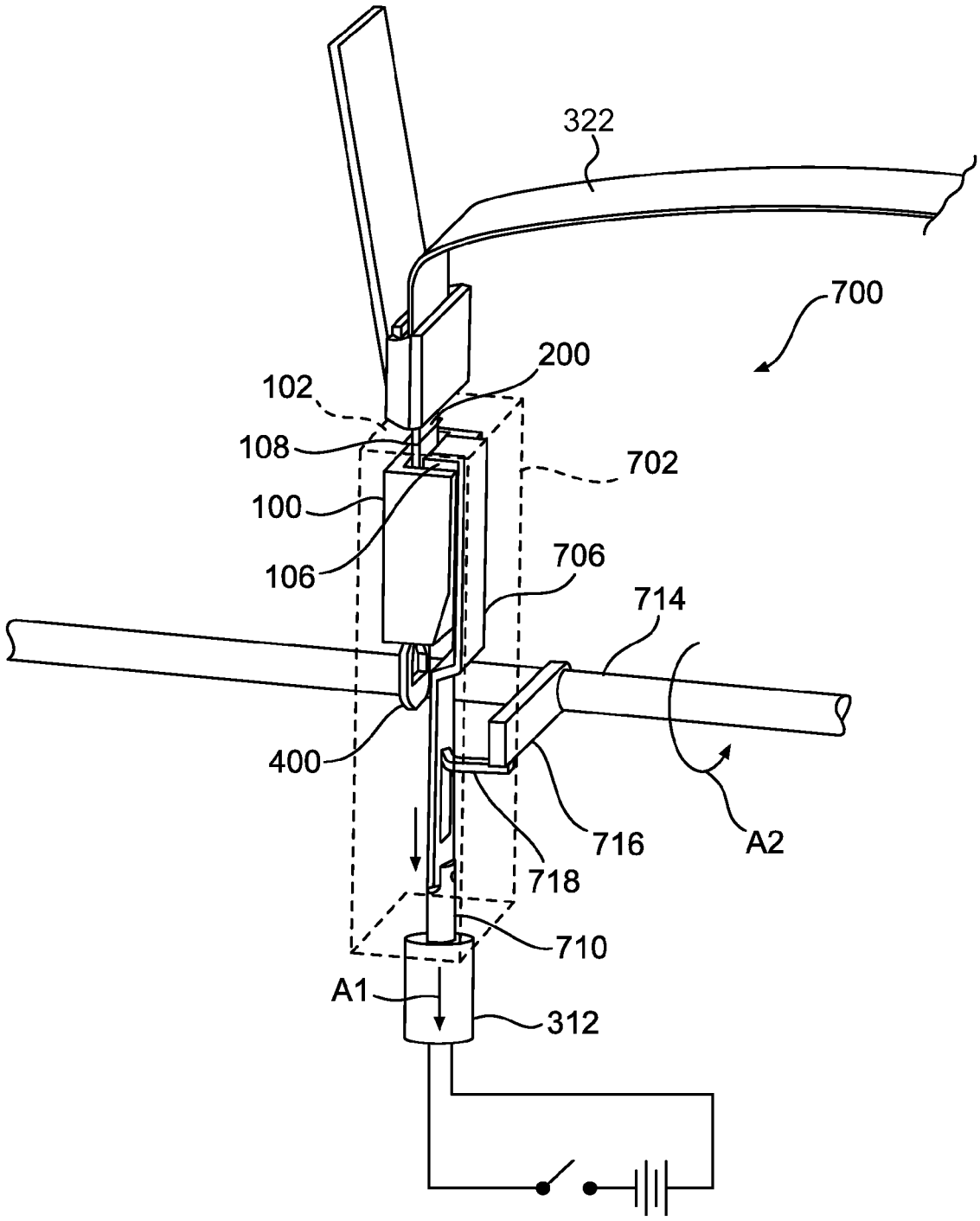
FIG. 7 is a perspective view of a seatbelt release apparatus and associated components, including a housing comprising a "barrier" first wall having a slot penetrating therethrough, in accordance with an embodiment of the invention.

FIG. 7 is a perspective view of a seatbelt release apparatus 700 and associated components, including a housing 702 (similar to 300) comprising a "barrier" 102 first wall having a slot 108 penetrating therethrough, in accordance with an embodiment of the invention. In accordance with the embodiment of FIG. 7, the seatbelt apparatus includes an elongated force-transfer-structure 706, having an upper end and a distal opposing lower end; a solenoid plunger 710 and its associated solenoid 312. In addition, the seatbelt apparatus may include a rotatable shaft 714; a lever 716 extending transversely from the rotatable shaft 714; and a transverse member 718, extending from the force-transfer-structure 706, where the transverse member 718 is coupled to the lever 716.

The upper end of the force-transfer-structure 706 may be configured to rest on, or otherwise couple to, the release button 106 of the buckle 100. The lower end of the force-transfer-structure 706 may be configured to couple to the plunger 710 of the solenoid 312. The solenoid plunger 710 may be oriented to exert a linear force (depicted by arrow A1) on the force-transfer-structure 706. The linear force A1 may be transferred to the release button 106 of the buckle 100.

In the configuration shown, a retraction of the plunger 710 into the solenoid 312 causes a downward linear force to be transferred to the top of the release button 106 of the buckle 100. The downward linear force depresses the release button 106, thereby permitting release of the tongue 200 from the buckle 100. The downward linear force is transferred via the force-transfer-structure 706. Other configurations to transfer the force of the solenoid to the release button are within the scope of the invention.

In FIG. 7, the outline of the housing 702 is shown in dashed line for ease of illustration. In operation, the solenoid 312 may serve as a primary source of force used to depress the release button 106 of the buckle 100, thereby permitting the tongue 200 to be removed from the buckle 100.

Although the passenger cannot release the tongue 200 from the buckle 100 unless the solenoid 412 is energized, in addition to the use of the solenoid 412, a ride operator may have at least one, and preferably multiple alternate mechanisms to cause the release of the tongue 200.

For example, in the event of inoperability of the solenoid 312, the ride operator may be able to manually depress the release button 106. In one embodiment, manual depression of one or more release buttons 106 can be achieved by rotating the shaft 714 coupled to the one or more release buttons 106. The coupling may be through the force-transfer-structure 706 described above. In this embodiment, the coupling might be achieved by coupling a transverse member 718, which protrudes from the force-transfer-structure 706, to the lever 716, which protrudes from the rotatable shaft 714. Accordingly, such an embodiment may include a transverse member 718, having a first end fixed to the force-transfer-structure 706 and a second end, distal to the first end, extending away from the force-transfer-structure 706. The direction toward which the transverse member 718 extends away from the force-transfer-structure 706 may be generally perpendicular to the direction of motion of the force-transfer-structure 706. The lengthwise axis of the rotatable shaft 714 may be offset from the lengthwise axis of the transverse member 718. The lengthwise axis of the rotatable shaft 714 and of the transverse member 718 may be generally parallel to each other. Other arrangements and relative positions are within the scope of the invention. The lever 902 may be removably attached at a first end to the rotatable shaft 714. The lever 716 may extend generally perpendicularly away from the rotatable shaft 714 to a second end, which may be coupled to the second end of the transverse member 718.

In this embodiment, the rotatable shaft 714 and lever 716 are configured to exert a downward force on the transverse member 718 by rotation of the rotatable shaft 714 in a direction shown by arrow A2. In alternate embodiments, a structure may be provided at one end of the rotatable shaft 714 to receive a tool, such as a hex-wrench. In the event that the solenoid should fail, an attendant would be able to insert the handle 902 (FIG. 9) or tool into the structure and exert a force on the handle 902 or tool to rotate the rotatable shaft 714 and thereby cause the release of the tongue 200 from the buckle 100.

Figure 8A:
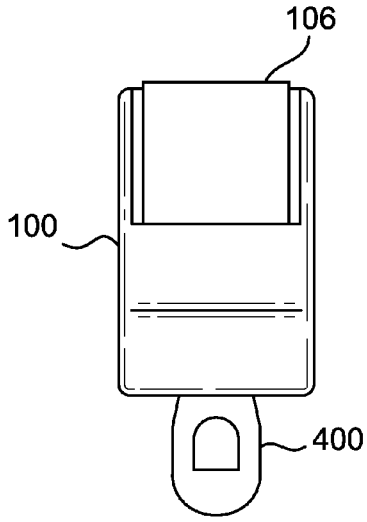
FIG. 8A PRIOR ART
FIG. 8A is an elevation view of a buckle that is utilized with the seatbelt release apparatus of FIG. 4.

FIG. 8A is an elevation view of a prior art buckle 100 that is utilized with the seatbelt release apparatus of FIG. 7. The buckle 100 is a well known device and can be obtained from any number of seatbelt manufacturers known to those of skill in the art. One example of an anchoring structure 400 is illustrated. In the embodiment of FIG. 8A, the buckle 100 is a type in which the release button 106 of the buckle 100 is depressed in the same direction as the direction in which the tongue is inserted into the body of the buckle 100. Other configurations of buckles can be used.

Figure 8B:
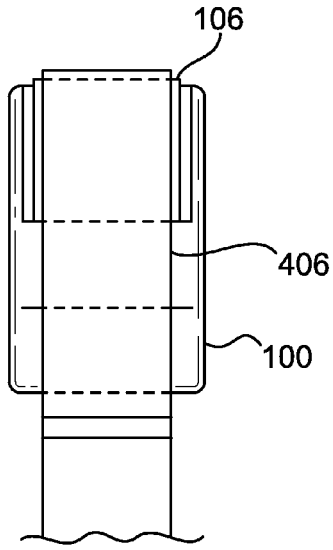
FIG. 8B is an elevation view of the buckle of FIG. 8A with a portion of a force-transfer-structure of the seatbelt release apparatus in a first operational position with respect to the buckle, in accordance with an embodiment of the invention.

FIG. 8B is an elevation view of the buckle 100 of FIG. 8A with a portion of the force-transfer-structure 706 of the seatbelt release apparatus in a first operational position with respect to the buckle 100, in accordance with an embodiment of the invention. For ease of illustration, the anchoring structure 400 is not shown. In this position, the release button 106 of the buckle 100 is not depressed; accordingly, if a tongue (not shown in FIG. 8) were inserted into the buckle 100, the tongue would be secured within the buckle 100.

Figure 8C:
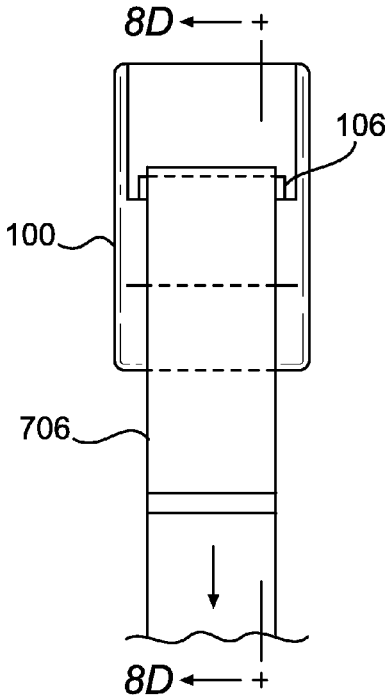
FIG. 8C is an elevation view of the buckle of FIG. 8A with the portion of the force-transfer-structure of the seatbelt release apparatus in a second operational position with respect to the buckle, in accordance with an embodiment of the invention.

FIG. 8C is an elevation view of the buckle 100 of FIG. 8A with the portion of the force-transfer-structure 706 of the seatbelt release apparatus in a second operational position with respect to the buckle 100, in accordance with an embodiment of the invention. For ease of illustration, the anchoring structure 400 is not shown. In this position, the release button 106 of the buckle 100 is depressed; accordingly, if a tongue (not shown in FIG. 8) was secured within the buckle 100 prior to depression of the release button 106 of the buckle 100, the tongue would be able to be released from the within the buckle 100.

Figure 8D:
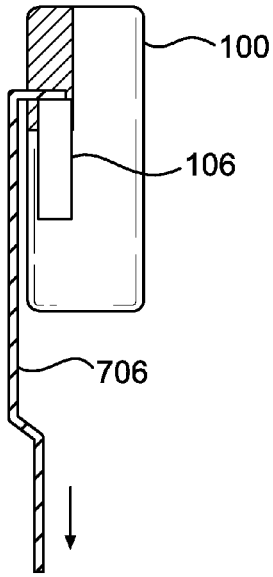
FIG. 8D is a left side view of the buckle and portion of the force-transfer-structure of FIG. 5C taken in the plane 8D-8D of FIG. 8C, all in accordance with the embodiment of the invention.

FIG. 8D is a left side view of the buckle 100 and portion of the force-transfer-structure 706 of FIG. 8C taken in the plane 8D-8D of FIG. 8C, all in accordance with the embodiment of the invention.

In the embodiments of FIGS. 7 and 8B-8D, the force-transfer-structure 706 is shaped such that the axis of the plunger 710 of the solenoid 312 is substantially centered with the center of the release button 106 of the buckle 100. In this configuration, substantially all of the downward force (where the downward direction is indicated by the downwardly pointing arrows in FIGS. 7, 8C, and 8D) generated by the retraction of the plunger 710 into the body of the solenoid 312 is transferred to the release button 106 of the buckle 100. Other shapes, which do or do not transfer substantially all of the downward force generated by the retraction of the plunger 710 into the body of the solenoid 412 are within the scope of the invention.

Figure 9:
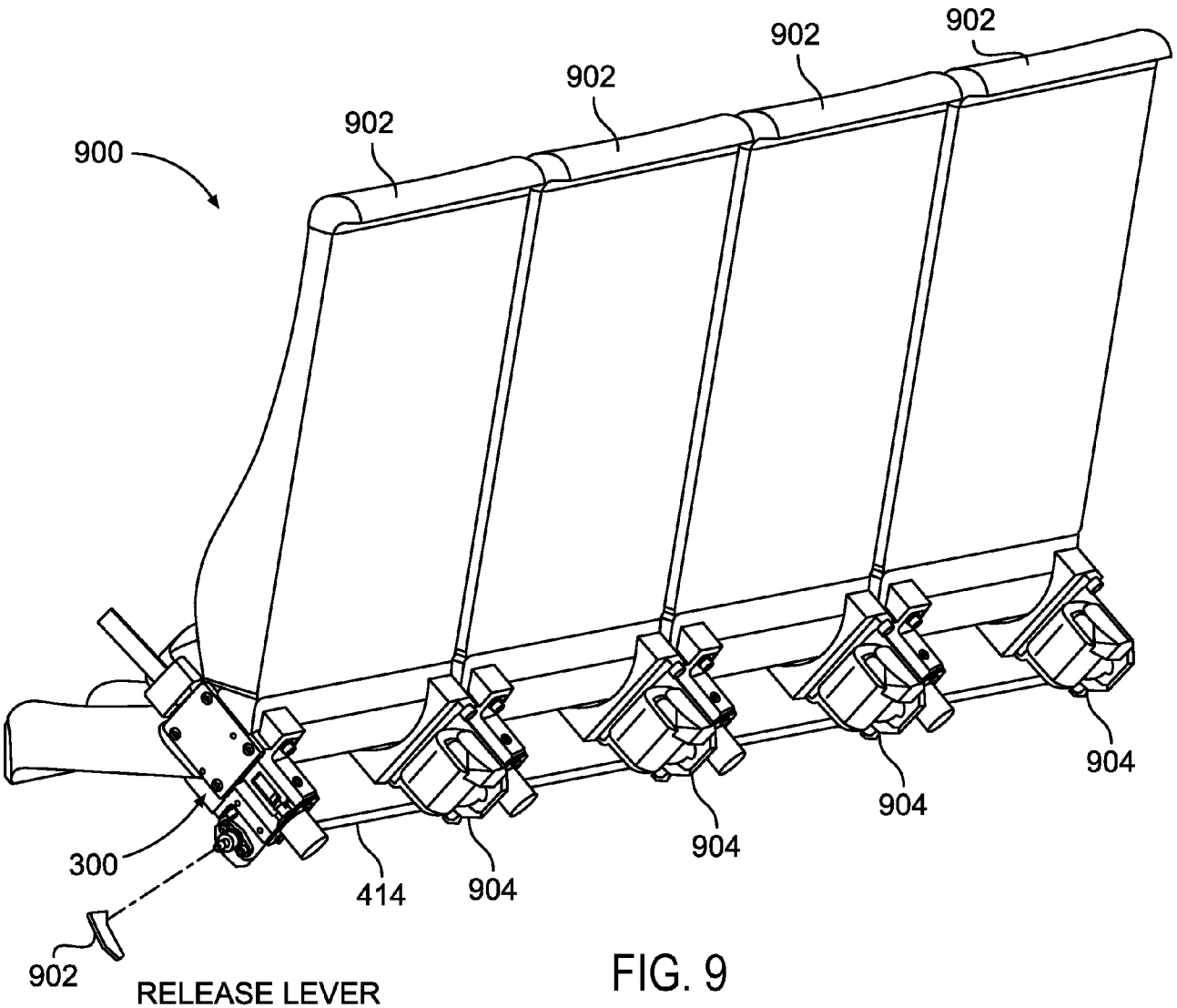
FIG. 9 is a rear perspective view of a plurality of seats, each including a housing having a barrier first wall and a slot therein (not shown) in accordance with an embodiment of the invention.

FIG. 9 is a rear perspective view of a plurality of seats 900, each including a housing 300 having a barrier first wall and a slot therein (not shown) in accordance with an embodiment of the invention. In the embodiment of FIG. 9, the rotatable shaft 714 is configured as a single shaft extending linearly from seat to seat. If the seats were not in a straight line, multiple individual shafts could be coupled together by torque transfer devices, such as universal joints.

A feature may protrude from the seat to accept a release lever 902. The release lever 902 may be removable, such that the release lever 902 would not be present during normal ride operations, but could be coupled, via the structure described in connection with FIG. 7, to the rotatable shaft 714 by a ride attendant. The release lever can be embodied in T or L shaped hex wrenches, any number of screwdrivers, or any form that allows for the release lever 902 to be coupled to the rotatable shaft 714 such that when coupled, rotation of the release lever 902 causes a related rotation of the rotatable shaft 714. In the event of the inoperability of one or more solenoids 312, rotation of the release lever 902 in a given direction rotates the rotatable shaft 714, thereby transferring a force to the force transfer structures 706 of each seat to push down on the tops of the release buttons 106, thereby releasing any tongues 200 from their respective buckles 100.

Each seat 902 includes a housing 300 comprising a "barrier" first wall having a slot 108 therein in accordance with an embodiment of the invention. A seatbelt buckle 100 may be housed within each housing 300. A retractor-housing 904 may store a length of retracted seatbelt webbing tethered to a tongue 200 therein.

Figure 10:
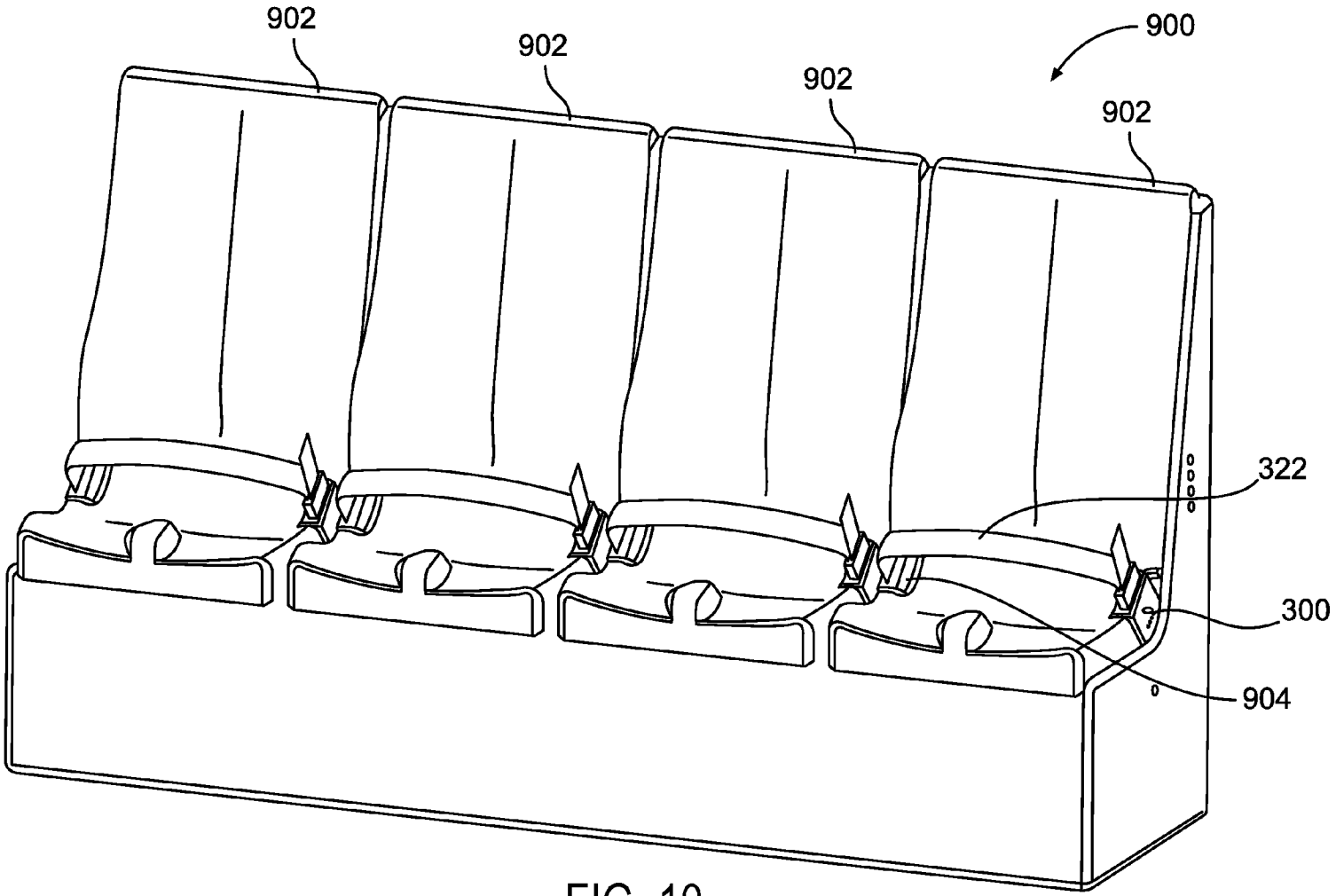
FIG. 10 is a front perspective view of the plurality of seats of FIG. 9.

FIG. 10 is a front perspective view of the plurality of seats 900 of FIG. 9. Seating arrangements having one or more seats are within the scope of the invention. The seating arrangement of FIG. 9 includes four substantially identical seats 902. In the embodiment shown, the seats 902 are in a straight row, however, seating arrangements in curved or other non-straight orientations are within the scope of the invention.

In FIG. 10, seatbelt webbing 322 is illustrated as being extracted from the retractor-housing 904. The webbing 322 is tethered to a tongue assembly, which is secured by the seatbelt tongue 200 (FIG. 2C) into the buckle 100 (FIG. 2C) within the housing 300. With the tongue 200 removably secured in the buckle and the unextracted portion of the seatbelt webbing restrained in the retractor housing 904, the seatbelt restraint system prevents a passenger from leaving the seat 902 and from tampering with the release button 106 associated with the seat 902.

The present invention has been described above in terms of one or more preferred embodiments and one or more alternate embodiments. Moreover, various aspects of the present invention have been described. One of ordinary skill in the art should not interpret the various aspects or embodiments as limiting in any way, but as exemplary. Clearly, other embodiments are within the scope of the present invention. The scope the present invention will instead be determined by the appended claims.

What is claimed is:

1. An apparatus to prevent tampering, comprising:

a barrier configured to maintain a fixed position with respect to a seat, the barrier separating a first space, on a first side of the barrier, from a second space, on a second side of the barrier;

a seatbelt buckle configured to maintain a fixed position with respect to the barrier in the second space, the seatbelt buckle comprising:

an opening having a first predetermined height and width, the opening to receive a seatbelt tongue, a release button configured to release the seatbelt tongue from a releasably secured state with the seatbelt buckle when the release button is operated; and a slot having a second predetermined height and width, penetrating the barrier and parallel to the opening, the second height and width selected to permit passage of the seatbelt tongue from the first space into the opening of the seatbelt buckle and prevent an object from passing through the slot to operate the release button.

2. The apparatus of claim 1, wherein the barrier includes a wall of a housing having a plurality of walls.

3. The apparatus of claim 2, wherein the housing has five or six walls.

4. The apparatus of claim 2, wherein at least one of the plurality of walls is removably secured to the housing.

5. The apparatus of claim 1, wherein the barrier is secured to the seat.

6. The apparatus of claim 2, wherein the at least a portion of the seatbelt buckle is covered by the housing.

7. The apparatus of claim 1, wherein the barrier is integral to a housing that covers the seatbelt buckle and wherein the slot and the housing together prevent an object in the first space from operational contact with the seatbelt buckle.

8. The apparatus of claim 1, wherein the release button is operated by depressing the release button in a first direction to release the seatbelt tongue from the seatbelt buckle.

9. The apparatus of claim 1, further comprising a mechanism in operational alignment with the release button and configured to operate the release button from the second space.

10. The apparatus of claim 1, wherein the slot prevents the object from passing through the slot to operate the release button when the tongue is in the releasably secured state with the seatbelt buckle.

11. An apparatus comprising:

a seatbelt buckle secured to a seat, the seatbelt buckle comprising an opening configured to receive a seatbelt tongue and a release button configured to release the seatbelt tongue from a releasably secured state with the seatbelt buckle;

a force-transfer-structure, having a first end configured to contact the release button, and a second end, distal to the first end;

a solenoid having a solenoid plunger coupled to the second end of the force-transfer-structure, the solenoid configured to exert a force on the force-transfer-structure to operate the release button;

wherein, the seatbelt buckle and force-transfer-structure are positioned relative to one another to maintain operational alignment between the release button and the first end of the force-transfer-structure.

12. The apparatus of claim 11, further comprising:

a housing covering at least a portion of the seatbelt buckle;

a slot penetrating a surface of the housing and configured to permit the seatbelt tongue to pass through the slot and enter the releasably secured state with the seatbelt buckle, wherein:

a minimum size of the slot permits entry of the seatbelt tongue, and a maximum size of the slot prevents an object from passing through the slot and operating the release button.

13. The apparatus of claim 12, wherein the slot prevents the object from passing through the slot to operate the release button when the seatbelt tongue is in the releasably secured state with the seatbelt buckle.

14. The apparatus of claim 11, further comprising:

a rotatable shaft;

a lever extending transversely from the rotatable shaft; and a transverse member, extending from the force-transfer-structure and coupled to the lever, wherein a rotation of the rotatable shaft exerts a force on the force-transfer-structure to operate the release button as an alternative to the force exerted by the solenoid.

15. A seatbelt release system, comprising:

a plurality of the apparatus as claimed in claim 13, joined in series, by joining the rotatable shafts of adjacent pairs of apparatus.

16. The seatbelt release system of claim 15, wherein the joined rotatable shafts are formed as a single shaft.

17. The seatbelt release system of claim 16, wherein at least one pair of joined rotatable shafts are joined by a torque transfer device.

18. An apparatus to permit remote actuation of a seatbelt buckle release button and prevent a passenger from locally actuating the release button, comprising:

the seatbelt buckle;

an electromechanical device configured to actuate the release button of the seatbelt buckle;

a housing covering at least the seatbelt buckle, the housing having a slot penetrating a surface of the housing and configured to permit a seatbelt tongue to pass through the slot, wherein:

a minimum size of the slot permits entry of the seatbelt tongue into the seatbelt buckle, and a maximum size of the slot prevents an object from passing through the slot and operating the release button; and a mechanical device configured to actuate the release button of the seatbelt buckle independently of the electromechanical device, wherein the electromechanical device and the mechanical device are not operable by the passenger.

19. The apparatus of claim 18, wherein the electromechanical device is a solenoid.

20. A system, comprising:

a plurality of apparatus as claimed in claim 18, wherein each of the apparatus are secured to a respective one of a plurality of seats, each mechanical device is operationally coupled to one another, and wherein the mechanical devices and electromechanical devices are further configured to maintain operational alignment with the release button of each of their respective seatbelt buckles.

* * * * *